US008041250B2

(12) United States Patent
Matsushita

(10) Patent No.: US 8,041,250 B2
(45) Date of Patent: Oct. 18, 2011

(54) DEVELOPING DEVICE AND IMAGE FORMING APPARATUS WITH SEAL MEMBERS

(75) Inventor: Yuichi Matsushita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 380 days.

(21) Appl. No.: 12/204,327

(22) Filed: Sep. 4, 2008

(65) Prior Publication Data

US 2009/0226207 A1 Sep. 10, 2009

(30) Foreign Application Priority Data

Sep. 4, 2007 (JP) ..... 2007-228986

(51) Int. Cl.
*G03G 15/08* (2006.01)

(52) U.S. Cl. ..... 399/103; 399/102; 399/105

(58) Field of Classification Search ..... 399/102, 399/103, 105

See application file for complete search history.

(56) References Cited

U.S. PATENT DOCUMENTS

| | | | | |
|---|---|---|---|---|
| 6,792,227 | B2 | 9/2004 | Itabashi | |
| 6,937,831 | B2 | 8/2005 | Kamimura | |
| 2002/0028086 | A1 * | 3/2002 | Sato et al. | 399/103 |
| 2003/0118364 | A1 | 6/2003 | Kamimura | |
| 2003/0123899 | A1 * | 7/2003 | Kamimura | 399/103 |
| 2005/0158070 | A1 * | 7/2005 | Ishii | 399/103 |

FOREIGN PATENT DOCUMENTS

| | | |
|---|---|---|
| EP | 1347346 | 9/2003 |
| JP | 2001-134085 | 5/2001 |
| JP | 2002-287488 | 10/2002 |
| JP | 2003-043812 | 2/2003 |
| JP | 2003-195630 | 7/2003 |

OTHER PUBLICATIONS

European Search Report for Application No. 08015473.5-2209/2034369 dated Sep. 25, 2009.

* cited by examiner

*Primary Examiner* — Ryan Walsh
(74) *Attorney, Agent, or Firm* — Banner & Witcoff, Ltd.

(57) ABSTRACT

A developing device according to an aspect of the invention includes: a housing; a developing roller comprising a roller main body having a circumferential surface, the developing roller being rotatably supported to the housing; and seal members respectively disposed to face both end portions of the circumferential surface of the roller main body with respect to a rotational axis direction thereof and to press contact with the roller main body. Each of the seal members comprises: a base material formed of an elastic element; and a sliding frictional member that is formed of fibers and contacts with the circumferential surface of the roller main body such that the roller main body frictionally slides on the sliding frictional member. Both edges of the circumferential surface of the roller main body with respect to the rotational axis direction thereof are brought into contact with the base materials.

7 Claims, 7 Drawing Sheets

DEVELOPING DEVICE AND IMAGE FORMING APPARATUS WITH SEAL MEMBERS

CROSS-REFERENCE TO RELATED APPLICATIONS

This application is based upon and claims priority from Japanese Patent Application No. 2007-228986 filed on Sep. 4, 2007, the entire contents of which are incorporated herein by reference.

TECHNICAL FIELD

The present invention relates to an image forming apparatus such as a laser printer and a developing device used for the image forming apparatus.

BACKGROUND

In an image forming apparatus such as a laser printer, an electrostatic latent image is formed on a surface of a photosensitive drum, and toner is fed to the elastic latent image from a developing device, whereby a toner image is formed on the surface of the photosensitive drum. Then, the toner image is transferred to a sheet of paper, and the image is formed on the sheet.

The developing device includes: a housing having an opening which is open towards the photosensitive drum; and a developing roller which is supported rotatably in the opening of the housing. Toner is held within the housing. The developing roller is configured such that a roller main body formed of a conductive elastic material is provided on and covers a metallic roller shaft. In the developing roller, a portion of a circumferential surface of the roller main body is exposed from the housing, and the exposed portion faces a surface of the photosensitive roller. The toner in the housing is carried on the surface of the roller main body of the developing roller, and the toner so carried is then fed to the surface of the photosensitive roller in association with the rotation of the developing roller, and the toner is fed to the electrostatic latent image that is formed on the surface of the photosensitive drum.

In the developing device, side seals are provided for preventing the leakage of the toner from both sides of the roller main body. Each side seal is formed by affixing a sliding frictional member formed of fibers to a sponge member made from urethane foam. The side seals are respectively secured to positions which face both end portions of the roller main body of the developing roller. When the developing roller is attached to the housing, the sliding frictional members are brought into contact with portions of the circumferential surface of the roller main body which extends inwards from both edges of the circumferential surface by a predetermined width, whereby the side seals are pressed by the developing roller. The sponge member has an appropriate thickness, and when the developing roller is attached to the housing, the sponge member is compressed between the roller main body and the housing so as to produce an appropriate elastic force. By this elastic force, the side seals (the sliding frictional seal members) are brought into press contact with both the axial end portions of the roller main body, whereby seals are established between both the end portions of the roller main body and the housing by the side seals. This kind of the developing device is disclosed in JP-2003-A-195630, for example.

SUMMARY

The sliding frictional member formed of fibers is harder than the sponge member formed of urethane foam. In other words, the sliding frictional member has a smaller elastic force than that of the sponge member. Because of this, when the side seals are pressed by the roller main body of the developing roller, the sliding frictional members are bent in the portions where the sliding frictional members abut the edges of the circumferential surface of the roller main body, whereby the roller main body receives a reaction force from the roller main body, which is directed inwards with respect to the rotational axis direction of the developing roller. As a result, a force component directed inwards in the rotational axis direction is included in a pressure which the side seals receive from the roller main body, whereby the sponge seal members are distorted to be deformed in such a manner as to fall inwards in the rotational axis direction. When the sponge members are distorted to be deformed, the contact pressure of the sliding frictional members to the surface of the roller main body become weak, which leads to a leakage of toner from those portions where the contact pressure is weakened.

One aspect of the invention has been made in view of the above circumstances, and an object thereof is to provide a developing device and an image forming apparatus which can prevent the distorted deformation of the base materials of the seal members, so as to prevent properly the leakage of toner from both the end portions of the roller main body of the developing roller.

According to an aspect of the invention, there is provided a developing device comprising: a housing having an opening; a developing roller comprising a roller main body having a circumferential surface configured to carry developer thereon, the developing roller being rotatably supported to the housing, and at least a part of the circumferential surface of the roller main body being exposed through the opening of the housing; and seal members respectively disposed to face both end portions of the circumferential surface of the roller main body with respect to a rotational axis direction thereof and to press contact with the roller main body to prevent leakage of the developer from the opening, wherein each of the seal members comprises: a base material formed of an elastic element; and a sliding frictional member that is formed of fibers and contacts with the circumferential surface of the roller main body such that the roller main body frictionally slides on the sliding frictional member, and wherein both edges of the circumferential surface of the roller main body with respect to the rotational axis direction thereof are brought into contact with the base materials.

According to another aspect of the invention, there is provided an image forming apparatus comprising a developing device, said developing device comprising: a housing having an opening; a developing roller comprising a roller main body having a circumferential surface configured to carry developer thereon, the developing roller being rotatably supported to the housing, and at least a part of the circumferential surface of the roller main body being exposed through the opening of the housing; and seal members respectively disposed to face both end portions of the circumferential surface of the roller main body with respect to a rotational axis direction thereof and to press contact with the roller main body to prevent leakage of the developer from the opening, wherein each of the seal members comprises: a base material formed of an elastic element; and a sliding frictional member that is formed of fibers and contacts with the circumferential surface of the roller main body such that the roller main body frictionally slides on the sliding frictional member, and wherein both edges of the circumferential surface of the roller main body with respect to the rotational axis direction thereof are brought into contact with the base materials.

DESCRIPTION

1. Color Laser Printer

Figure 1:
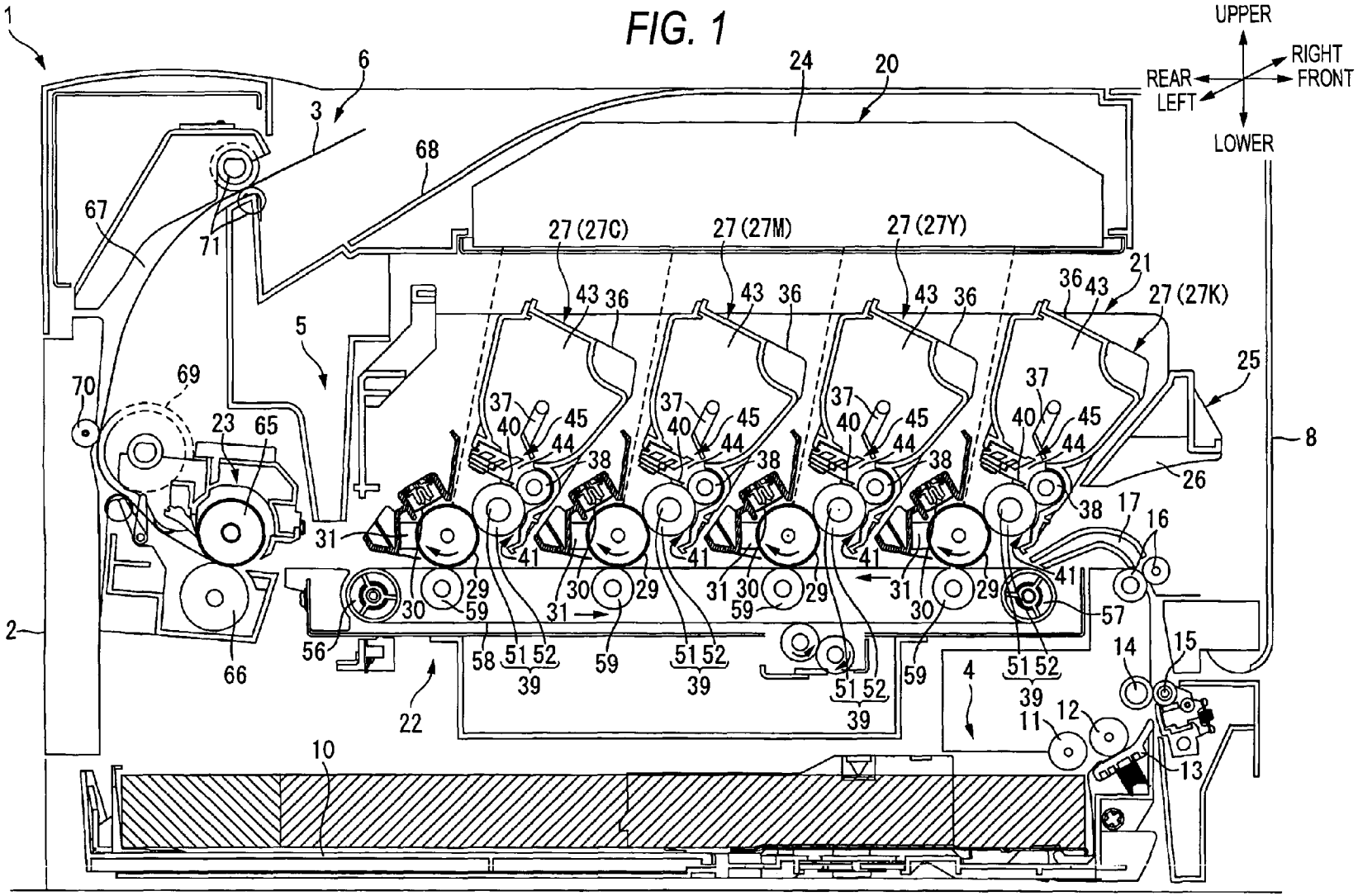
FIG. 1 is a sectioned side view showing a color laser printer as an example of an image forming apparatus of an embodiment of the invention.

FIG. 1 is a sectioned side view showing a color laser printer as an example of an image forming apparatus according to an embodiment of the invention.

A color laser printer 1 includes a main body casing 2, a sheet feeding unit 4 for feeding sheets 3, an image forming unit 5 for forming an image on the sheets 3 fed by the sheet feeding unit 4, and a sheet discharging unit 6 for discharging the sheets 3 on which the image is formed. The sheet feeding unit 4, the image forming unit 5 and the sheet discharging unit 6 are provided in the main body casing 2.

Note that in the following description, the right side in FIG. 1 is referred to as a front side and the left side in FIG. 1 is referred to as a rear side. In addition, the left side and the right side of the color laser printer 1 are respectively referred to as the left side and the right side when viewed from the front side of the color laser printer 1. In a latter description, directions on a drum unit 25 and a developing cartridge 27 will be described based on a state where they are attached to the main body casing 2.

(1) Sheet Feeding Unit

The sheet feeding unit 4 includes a sheet feeding tray 10, a sheet feeding roller 11, a separation roller 12, a separation pad 35, a pinch roller 14, a sheet dust removing roller 15 and a pair of registration rollers 16.

A sheet 3 is fed out of the sheet feeding tray 10 to a sheet feeding path 17 by the rotation of the sheet feeding roller 11. The sheet 3 so fed out moves along the sheet feeding path 17 and passes sequentially between the separation roller 12 and the separation pad 13 and between the pinch roller 14 and the sheet dust removing roller 15 so as to be conveyed to the registration rollers 16. The registration rollers 16 register the sheet 3 and thereafter convey it to a conveyer belt 58.

(2) Image Forming Unit

The image forming unit 5 includes a scanner unit 20, a processing unit 21, a transfer unit 22 and a fixing unit 23.

(2-1) Scanner Unit

The scanner unit 20 is disposed in an upper portion of the main body casing 2. This scanner unit 20 includes a laser and optical members such as mirrors and lenses and emits four laser beams towards four photosensitive drums 29, which will be described later. As is indicated by broken lines in FIG. 1, the laser beams are irradiated to surfaces of the photosensitive drums 20, respectively.

(2-2) Processing Unit

The processing unit 21 is disposed below the scanner unit 20 and above the sheet feeding unit 4. The processing unit 21 includes a drum unit 25 and developing cartridges 27 as examples of four developing devices which correspond to respective colors such as black, yellow, magenta and cyan.

In the drum unit 25, the four photosensitive drums 29 which respectively correspond to the four colors are disposed in parallel with one another with a certain space defined therebetween in the front to rear or longitudinal direction of the laser printer. In addition, a scorotron charger 30 and a cleaning brush 31 are provided in with each photosensitive drum 29.

The developing cartridge 27 includes a housing 36 which accommodate therein an agitator 37, a feed roller 38, a developing roller 39 and a layer thickness control blade 40.

The housing 36 has a box shape which has an opening 41 formed at a lower end portion thereof. A toner accommodation chamber 43 and a developing chamber 44 are formed vertically within the housing 36. The toner chamber 43 and the developing chamber 44 can communicate with each other via a communication port 45. The toner accommodation chamber 43 may be detachable from the developing chamber 44.

Toner as developer whose color corresponds to one of the four developing cartridges 27 is held within the toner accommodation chamber 43. As toners of the respective colors, positively charged, non-magnetic and one-component polymerization toners are used into which pigments of yellow, magenta, cyan and black are formulated to correspond to the respective colors.

The agitator 37 is provided within the toner accommodation chamber 43.

The feed roller 38 is provided below the communication port 45 within the developing chamber 44. The feed roller 38 includes a rotation shaft supported by the housing 36 and the sponge roller portion attached to the rotation shaft.

The developing roller 39 is provided obliquely rearwards and downwards relative to the feed roller 38 within the developing chamber 44. This developing roller 39 includes a metallic roller shaft 51 and a roller main body 52 which covers the roller shaft 51 and which is formed of a conductive rubber. A portion of a circumferential surface of the roller main body 51 is exposed downwards from the opening 41 of the developing chamber 44. In addition, the roller main body 52 is brought into press contact with a circumferential surface of the sponge roller portion of the feed roller 38.

The layer thickness control blade 40 has a plate shape which extends in the left to right or width direction of the developing roller 39 and is provided such that a proximal end portion of the layer thickness control blade 40 is fixed to the housing 36, while a free end portion thereof is brought into press contact with the roller main body 52 of the developing roller 39 from thereabove.

In each developing cartridge 27, the toner corresponding to respective color and held in the toner accommodation chamber 43 is caused to move to the communication port 45 while being agitated by the agitator 37 and is then discharged to the developing chamber 44 from the communication port 45. The toner discharged into the developing chamber 44 is fed to the feed roller 38. The toner fed to the feed roller 38 is fed to the developing roller 39 by the rotation of the feed roller 38. As this occurs, the toner is friction charged positively between the feed roller 38 and the developing roller 39 to which a developing bias is being applied. The thickness of the toner fed to the developing roller 39 is controlled by the layer thickness control blade 40 in association with the rotation of the developing roller 39 and is carried on a surface of the roller main body 52 as a thin layer having a constant thickness.

On the other hand, a surface of the photosensitive drum 29 which corresponds to respective one of the four cartridges 27 is uniformly positively charged by the scorotron charger 30 in association with the rotation of the photosensitive drum 29. In addition, due to the laser beam irradiated to the positively charged surface of the photosensitive drum 29 from the scanner unit 20, an electrostatic latent image corresponding to an image to be formed on the sheet 3 is formed on the surface of the photosensitive drum 29.

When the electrostatic latent image formed on the surface of the photosensitive drum 29 faces the developing roller 39 as a result of rotation of the photosensitive drum 29, the positively charged toner carried on the surface of the developing roller 39 is fed to the electrostatic latent image (that is, of the uniformly positively charged surface of the photosensitive drum 29, an exposed portion which is exposed by the laser beam and hence whose potential is reduced), whereby the electrostatic latent image is visualized, and a toner image respective color by inversion development is carried on the surface of the photosensitive drum 29.

(2-3) Transfer Unit

Within the main body casing 2, the transfer unit 22 is disposed above the sheet feeding unit 4 and below the processing unit 21. This transfer unit 22 includes a drive roller 56, a driven roller 57, the conveyer belt 58 and transfer rollers 59.

The drive roller 56 and the driven roller 57 are disposed to be spaced from and opposed to each other with respect to the longitudinal direction of the laser printer.

The conveyer belt 58 is formed of an endless belt and extends between and is wound around the drive roller 56 and the driven roller 57.

The drive roller 56, the driven roller 57 and the conveyer belt 58 are disposed such that a surface of an upper side portion of the conveyer belt 58 is brought into contact with the photosensitive drums 29. The drive roller 56 is caused to rotate in an opposite direction (a counterclockwise direction as viewed in the figure) to the photosensitive drums 29 by driving force from a motor (not shown). When the drive motor 56 is caused to rotate, the conveyer belt 58 loops in the same direction as the drive roller 56, and the driven roller 57 is driven by the conveyer belt 58 and rotates.

The transfer rollers 59 are provided within a ring of the conveyer belt 58 extend between and wound around the drive roller 56 and the driven roller 57, and the transfer rollers 59 are opposed to the corresponding photosensitive drums 29 across the conveyer belt 58.

The sheet 3 conveyed from the sheet feeding unit 4 is fed to the conveyer belt 58 and is then conveyed thereon to pass sequentially between the photosensitive drums 29 and the conveyer belt 58 as the conveyer belt 58 runs in a loop. While the sheet 3 is conveyed in this way, the toner images carried on the photosensitive drums 29 are transferred to the sheet 3 by transfer bias applied to the transfer rollers 59, whereby the toner images of the colors carried on the respective photosensitive drums 29 are sequentially overlapped one on another, so as to form a color image on the sheet 3.

(2-4) Fixing Unit

The fixing unit 23 is disposed on the rear side or downstream of the transfer unit 22 and includes a heating roller 65 and a pressure roller 66 which presses against the heating roller 65.

In the fixing unit 23, the color image transferred to the sheet 3 is thermally fixed to the sheet 3 by heating and pressing the sheet 3 while the sheet 3 passes between the heating roller 65 and the pressure roller 66.

(3) Sheet Discharging Unit

The sheet discharging unit 6 includes a sheet discharging path 67. On this sheet discharging path 67, there are provided a conveyer roller 69, a pinch roller 70 and a pair of sheet discharging rollers 71. The sheet 3 conveyed from the fixing unit 23 is conveyed along the sheet discharging path 67 by the conveyer roller 69 and the pinch roller 70 and is then discharged to a sheet discharging tray 68 formed on an upper surface of the main body casing 2 by the sheet discharging rollers 71.

2. Developing Cartridge

Figure 2:
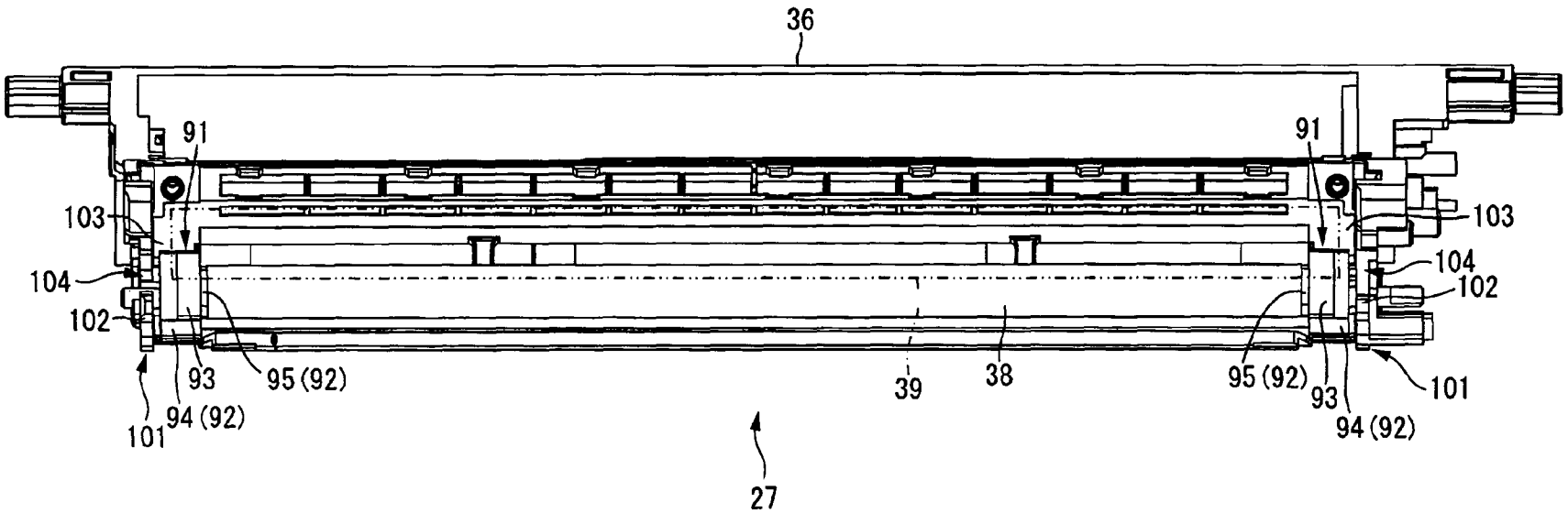
FIG. 2 is a view of a developing cartridge as seen from therebelow in a state where a developing roller and a layer thickness control blade are removed.
Figure 3:
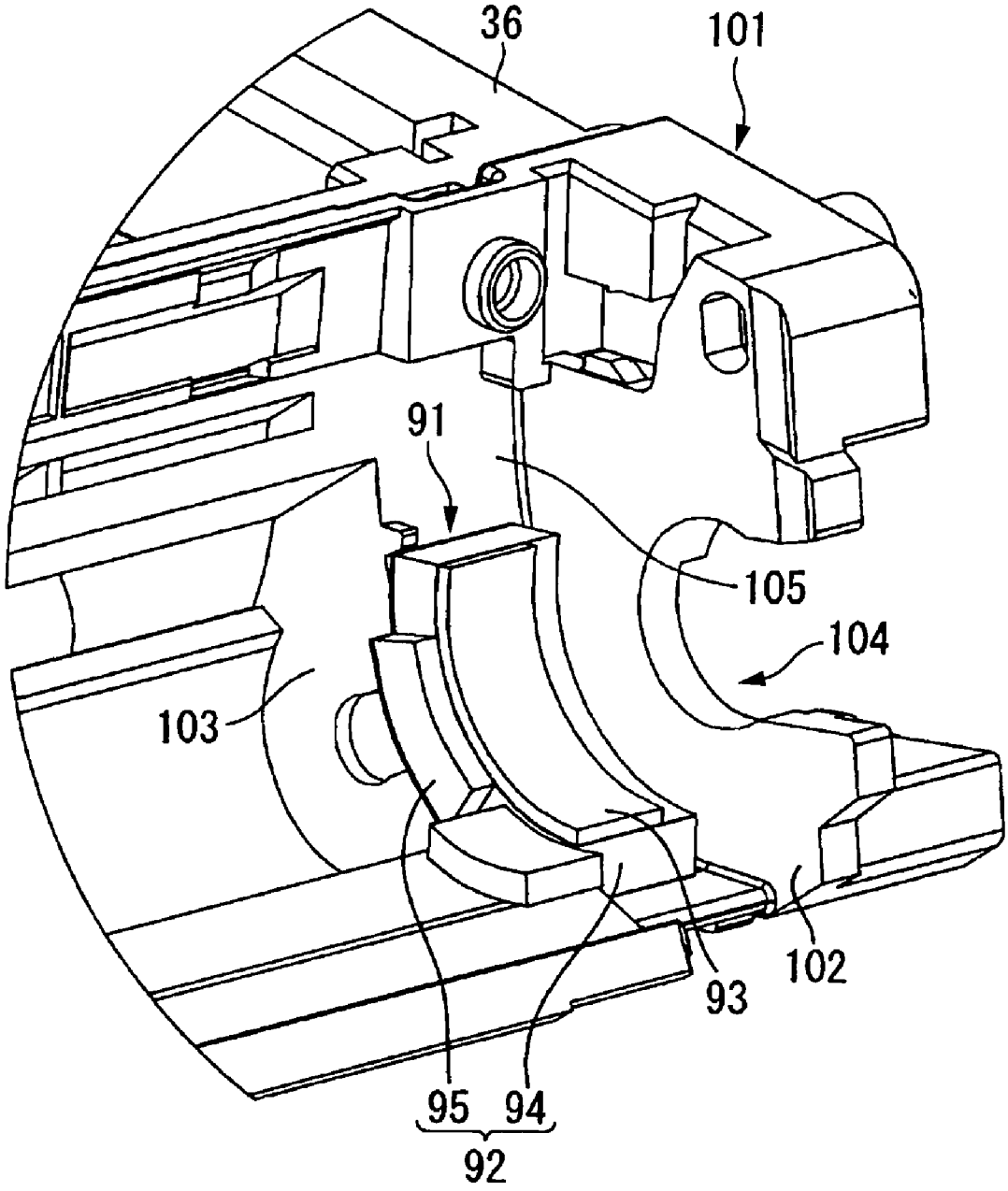
FIG. 3 is an enlarged perspective view of a left end portion of the developing cartridge shown in FIG. 2.
Figure 4:
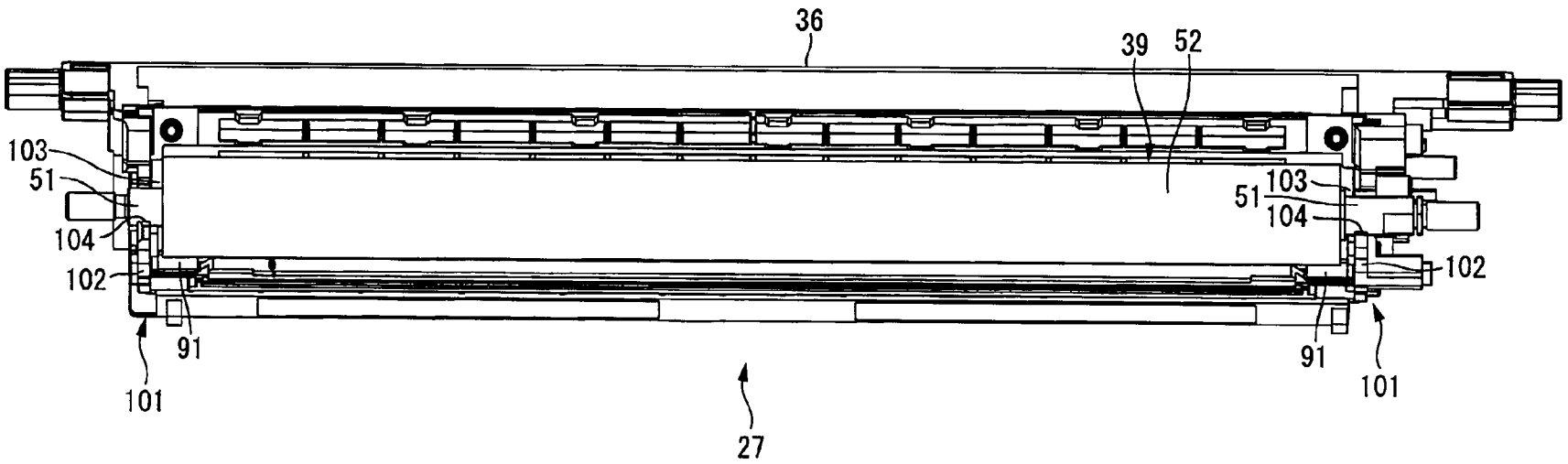
FIG. 4 is a view of the developing cartridge as seen from therebelow in a state where the layer thickness control blade is removed (in a state where the developing roller is kept attached)
Figure 5:
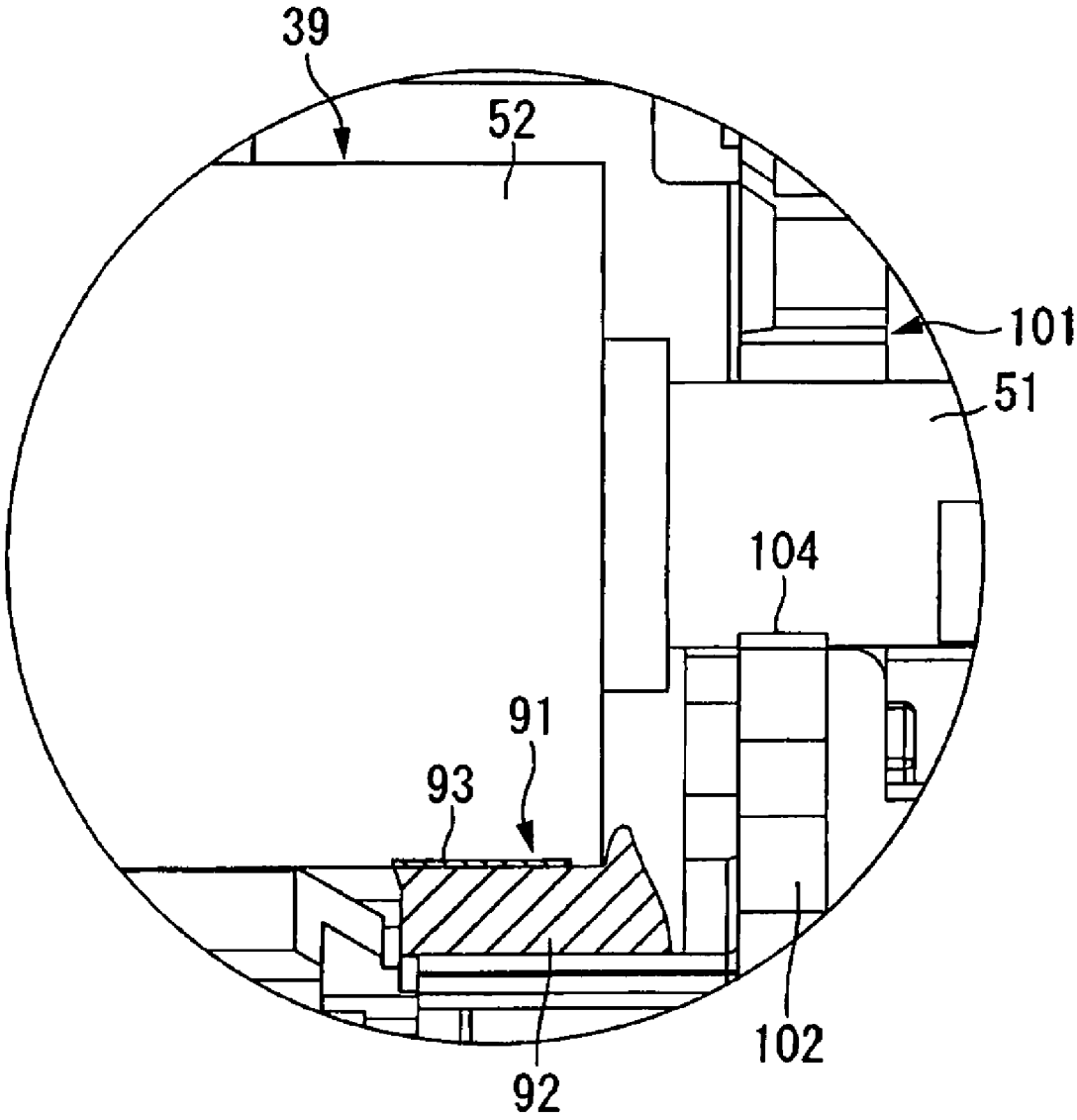
FIG. 5 is an enlarged view of a portion of the developing roller shown in FIG. 4 which lies in the vicinity of a left end portion thereof.

FIG. 2 is a view of the developing cartridge 27 as seen from therebelow in a state where the developing roller 39 and the layer thickness control blade 40 are removed. FIG. 3 is an enlarged perspective view of a left end portion of the developing cartridge 27 shown in FIG. 2. FIG. 4 is a view of the developing cartridge 27 as seen from therebelow in a state where the layer thickness control blade 40 is removed (with the developing roller 39 kept attached). FIG. 5 is an enlarged view of a portion of the developing roller 39 shown in FIG. 4 which lies in the vicinity of a left end portion thereof (with a side seal 91, which will be described later, shown sectioned).

(1) Housing

The housing 36 of the developing cartridge 27 includes side walls 101 which define the opening 41 therebetween in the left to right or width direction thereof.

Each side wall 101 includes a support plate portion 102 for supporting the developing roller 39 and a seal disposing portion 103 where the side seal 91 is disposed in the opening 41.

A shaft supporting groove 104 is formed at the support plate portion 102 such that the support plate portion 102 is cut out upwards from a lower edge thereof. End portions of the roller shaft 51 of the developing roller 39 are respectively received in the shaft supporting grooves 104 formed at both ends in the left and right direction, whereby the developing roller 39 is supported rotatably by both the side walls 101 of the housing 36.

The seal disposing portion 103 is disposed adjacent to an inner side of the opening 41 in the longitudinal direction of the housing 36. As shown in FIG. 3, the seal disposing portion 103 has a roller opposing surface 105 which faces an end portion of the roller main body 52 of the developing roller 39 and extends in a curved shape along the outer circumferential surface of the roller main body 52 thereof.

(2) Side Seal

The side seal 91, which serves as an example of a seal member for preventing the leakage of toner from the end portion of the roller main body 52, is disposed on the roller opposing surface 105.

The side seal 91 includes a base material 92 and a sliding frictional member 93 which overlays the base material 92.

The base material 92 is made of an elastic material such as urethane foam or, more specifically, a urethane foam sponge material (a trade name: PORON made by ROGERS & INOAC Corporation) having a relatively high rigidity among sponge materials. The thickness of base material 92 is set to produce an appropriate elastic force when the base material 92 is compressed between the opposing surface 105 and the roller main body 52 of the developing roller 39 in a state where the developing roller 39 is attached to the housing 36. In addition, the base material 92 includes integrally a substantially rectangular parallelepiped main body portion 94 and a projecting portion 95 which projects inwards in a rotational axis direction of the developing roller 39 (hereinafter, this direction is to be referred to simply as a "rotational axis direction") in a rectangular parallelepiped shape from a central portion on a side surface of the main body portion 94. As shown in FIG. 2, the projecting portion 95 contacts with an end face of the feed roller 38 at a side surface in the rotational axis direction.

The sliding frictional member 93 is made of felt which is made of polyester-based fibers. The sliding frictional member 93 is, as shown in FIG. 3, is formed in the same size as that of the main body portion 94 of the base material 92 in a circumferential direction of the roller main body 52 (hereinafter, this direction is to be referred to simply as a "circumferential direction") and is formed narrower than the width of the main body portion 94 in the rotational axis direction. The sliding frictional member 93 is affixed to the main body portion 94 such that both edges of the sliding frictional member 93 with respect to the circumferential direction are aligned with both edges of the main body portion 94 with respect to the circumferential direction, and an inner side edge of the sliding frictional member 93 with respect to the rotational axis direction (side edge closer to an axial center of the roller main body 52) is aligned with an inner side edge of the main body portion 94 with respect to the rotational axis direction.

3. Advantages

When the developing roller 39 is attached to the housing 36 by fitting both the end portions of the roller shaft 51 of the developing roller 39 in both the shaft support grooves 104, respectively, the side seals 91 are pressed against by the end portions of the roller main body 52 of the developing roller 39. As this occurs, both edges of the circumferential surface of the roller main body 52 are brought into contact with surfaces of the base materials 92 which are exposed on outer sides of the sliding frictional members 93 in the rotational axis direction, and the sliding frictional members 93 contact the circumferential surface of the roller main body 52 over the overall widths of the sliding frictional members 93 in the rotational axis direction. Consequently, the sliding frictional members 93 are not bent and deformed by the pressure exerted on the side seals 91 by the roller main body 52. In addition, the diameter of the end portions in the rotational axis direction of the roller main body 52 is increased towards the edges from the machining point of view, that is, the roller main body 52 has an inverted crown shape. Therefore, when both edges of the circumferential surface of the roller main body 52 is brought into contact with the base materials 92, an amount of compression at a portion of the base material 92 which is brought into contact with the roller main body 52 is larger than that at a portion of the base material 92 which contacts with the sliding frictional member 93. That is, both edges of the roller main body 52 bite into the base materials 92. Accordingly, the base materials 92 receive a force directed outwards in the rotational axis direction at the portions where the base materials 92 are brought into contact with the roller main body 52. Consequently, a force directed inwards in the rotational axis direction is not included in the pressure which the side seals 91 receive from the roller main body 52. Because of this, as shown in FIG. 5, the base materials 92 are compressed and deformed in a radial direction of the roller main body 52 by the pressure with which the side seals 91 are pressed against by the roller member 52 and hence are not distorted to be deformed to fall inwards in the rotational axis direction. As a result of this, the leakage of toner from both the end portions of the roller main body 52 can be prevented properly.

Furthermore, in the developing cartridge 27, since the projecting portions 95 of the base materials 92 contact with the end faces of the sponge roller portion of the feed roller 38, the base materials 92 are reliably prevented from being distorted and deformed to fall inwards in the rotational axis direction.

The outer side edges of the sliding frictional members 93 with respect to the rotational axis direction are disposed further inwards (closer to an axial center of the roller main body 52) than the edges of the roller main body 52. Because of this, the edges of the roller main body 52 can be brought into contact with the base materials 92.

The sliding frictional member 93 does not project from the base material 92 in the circumferential direction. Therefore, the side seals 91 can be attached to the housing 36 by attaching the base materials 92 to the housing 36 after preparing the side seals 91 by disposing the sliding frictional members 39 on the base materials 92. Accordingly, the labor hours involved in the attachment of the side seals 91 to the housing 36 can be reduced.

4. Other Embodiments (1) Sliding Frictional Member

The sliding frictional member 93 of the above embodiment is made of felt as polyester-based fibers. However, the sliding frictional member 93 may be formed using fibers such as Kashmir-based fibers.

Figure 6:
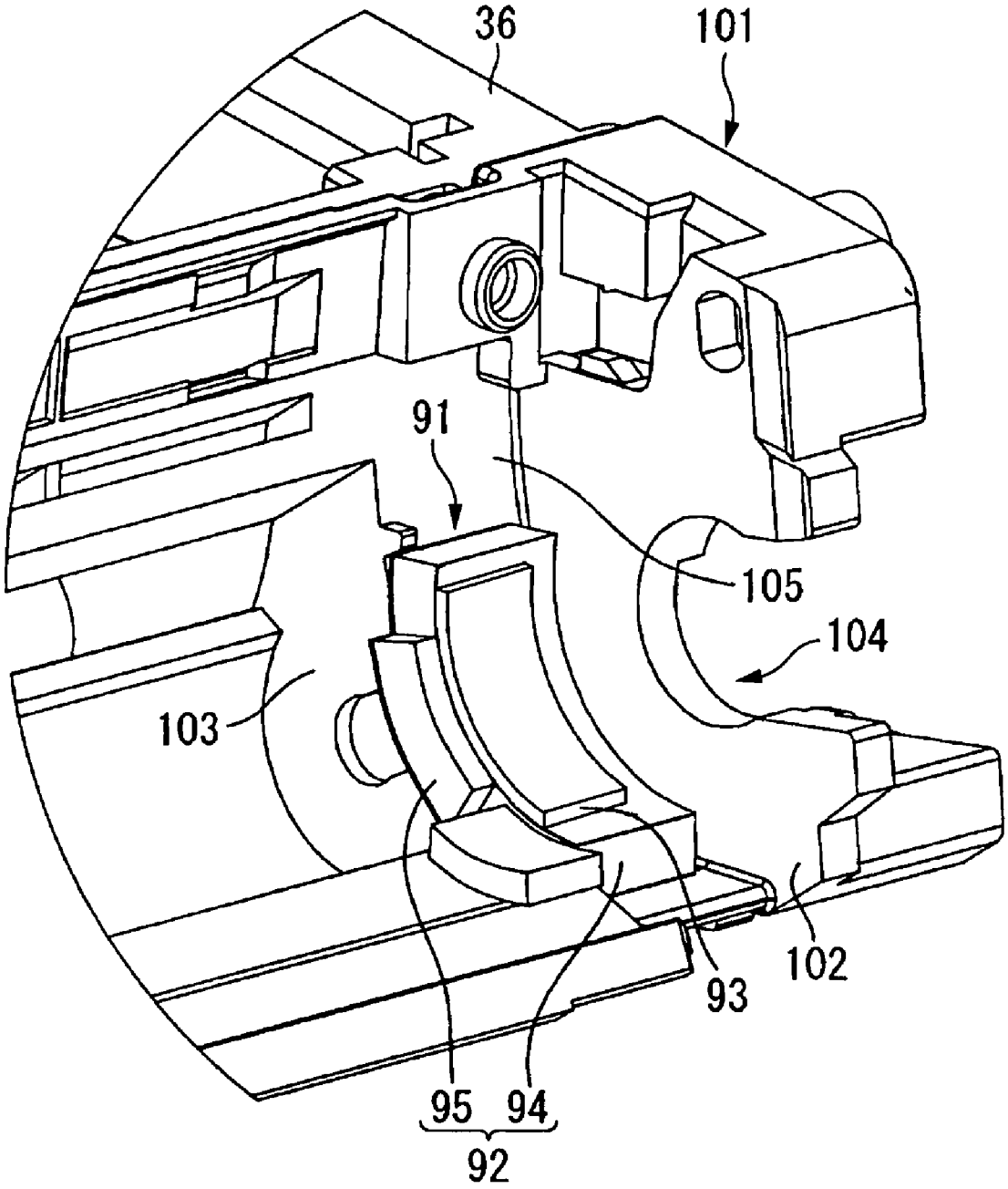
FIG. 6 is an enlarged perspective view of a left end portion of the developing cartridge according to another embodiment of the invention.

In the above embodiment, the sliding frictional member 93 has the same size as the main body portion 94 of the base material 92 in the circumferential direction. However, the sliding frictional member 93 may be smaller than the main body portion 94. For example, as shown in FIG. 6, the sliding frictional member 93 may be affixed to the main body portion 94 such that at least one of the circumferential edges of the sliding frictional member 93 are disposed further circumferentially inwards than the circumferential edges of the main body portion 94. That is, at least one of edges of the sliding frictional member 93 with respect to the circumferential direction of the roller main body 52 may be disposed on the base material 94 and within a range defined between both edges of the base material 94 with respect to the circumferential direction of the roller main body 52.

Additionally, it is sufficient that the sliding frictional member 93 does not contact with the edges of the circumferential surface of the roller main body 52 of the developing roller 39, and hence, the sliding frictional member 93 may have a quadrangular frame-like shape as viewed from the top which has the same external shape as the base material 92 and which is cut out in a portion which faces the edge of the circumferential surface of the roller main body 52.

(2) Base Material

Figure 7:
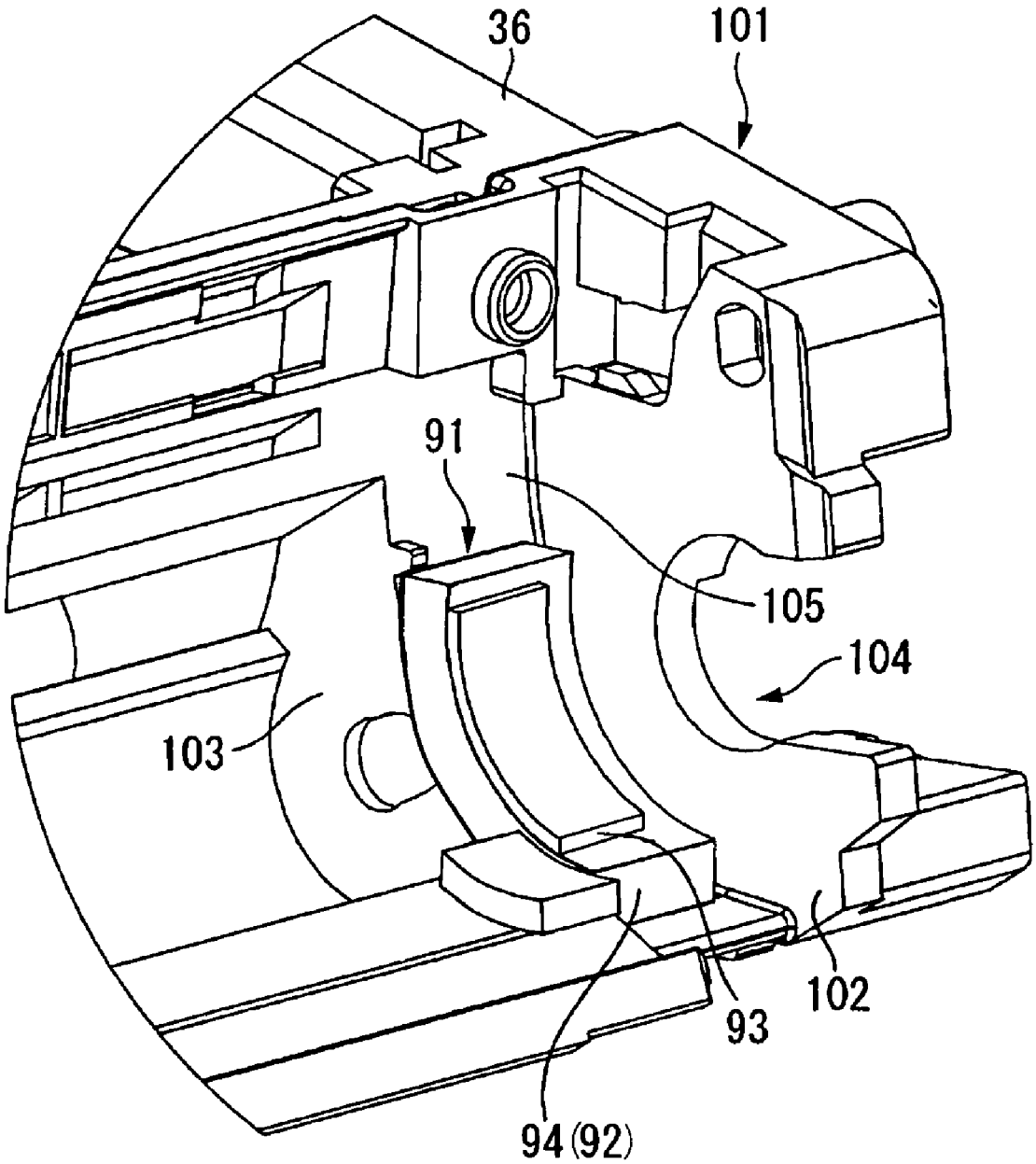
FIG. 7 is an enlarged perspective view of a left end portion of the developing cartridge according to still another embodiment of the invention.

As shown in FIG. 7, the base material 92 may not include the projection portion 95. In this case, the main body portion 94 of the base material 92 may contact with the end face of the sponge roller portion of the feed roller 38. Specifically, the main body portion 94 has: a first face on which the sliding frictional member 93 is provided; and a second face directed inwards with respect to the rotational axis direction. The first face contacts with the edge of the roller main body 52, and the second face contacts with the end face of the sponge roller portion of the feed roller 38.

(3) Image Forming Apparatus

In the above embodiment, the direct transfer-type color laser printer has been illustrated as the image forming apparatus, but the invention is not limited to the image forming apparatus so illustrated. For example, the invention may be applied to an intermediate transfer-type color laser printer in which developer images in the respective colors are temporarily transferred to an intermediate transfer body from respective image carriers, and thereafter, the images on the intermediate transfer body are transferred to a recording sheet at one time. In addition, the invention may be applied to not only color laser printers but also monochrome laser printers.

What is claimed is:

1. A developing device comprising:

a housing having an opening;

a developing roller comprising a roller main body having a circumferential surface configured to carry developer thereon, the developing roller being rotatably supported to the housing, and at least a part of the circumferential surface of the roller main body being exposed through the opening of the housing; and seal members respectively disposed to face both end portions of the circumferential surface of the roller main body with respect to a rotational axis direction thereof and to press contact with the roller main body to prevent leakage of the developer from the opening, wherein each of the seal members comprises: a base material formed of an elastic element; and a sliding frictional member that is formed of fibers and contacts with the circumferential surface of the roller main body such that the roller main body frictionally slides on the sliding frictional member, wherein both edges of the circumferential surface of the roller main body with respect to the rotational axis direction thereof are brought into contact with the base materials, wherein an outer side edge of the sliding frictional member with respect to the rotational axis direction is disposed further inwards than an edge of the roller main body, and an outer side edge of the base material with respect to the rotational axis direction is disposed further outwards than the edge of the roller main body, and wherein the sliding frictional member is configured to contact the circumferential surface of the roller main body over the overall width of the sliding frictional member in the rotational axis direction.

2. The developing device according to claim 1, wherein an outer side edge of the sliding frictional member with respect to the rotational axis direction is disposed closer to an axial center of the roller main body than the edge of the circumferential surface the roller main body.

3. The developing device according to claim 1, further comprising a feed roller rotatably supported to the housing and configured to feed the developer to the developing roller, wherein an end face of the feed roller contacts with the base material.

4. The developing device according to claim 3, wherein the base material comprises a main body portion, the main body portion having a first face brought into contact with the edge of the roller main body and a second face brought into contact with the end face of the feed roller.

5. The developing device according to claim 3, wherein the base material comprises: a main body portion that contacts with the edge of the roller main body; and a projecting portion which projects towards an axial center of the roller main body in the rotational axis direction from the main body portion, and wherein the projecting portion contacts with an end face of the feed roller.

6. The developing device according to claim 1, wherein edges of the sliding frictional member with respect to a circumferential direction of the roller main body are disposed on the base material and within a range defined between edges of the base material with respect to the circumferential direction of the roller main body.

7. An image forming apparatus comprising a developing device, said developing device comprising:

a housing having an opening;

a developing roller comprising a roller main body having a circumferential surface configured to carry developer thereon, the developing roller being rotatably supported to the housing, and at least a part of the circumferential surface of the roller main body being exposed through the opening of the housing; and seal members respectively disposed to face both end portions of the circumferential surface of the roller main body with respect to a rotational axis direction thereof and to press contact with the roller main body to prevent leakage of the developer from the opening, wherein each of the seal members comprises: a base material formed of an elastic element; and a sliding frictional member that is formed of fibers and contacts with the circumferential surface of the roller main body such that the roller main body frictionally slides on the sliding frictional member, wherein both edges of the circumferential surface of the roller main body with respect to the rotational axis direction thereof are brought into contact with the base materials, wherein an outer side edge of the sliding frictional member with respect to the rotational axis direction is disposed further inwards than an edge of the roller main body, and an outer side edge of the base material with respect to the rotational axis direction is disposed further outwards than the edge of the roller main body, and wherein the sliding frictional member is configured to contact the circumferential surface of the roller main body over the overall width of the sliding frictional member in the rotational axis direction.

* * * * *